US005970564A

United States Patent [19]

Inns et al.

[11] Patent Number: 5,970,564

[45] Date of Patent: Oct. 26, 1999

[54] BRUSH HAVING AN ELASTOMERIC BRIDGE

[75] Inventors: George Richard Inns; Stephen John Raven, both of Milan, Italy; Derek Guy Savill, Ashton, United Kingdom

[73] Assignee: Chesebrough-Pond's USA Co., Division of Conopco, Inc., Greenwich, Conn.

[21] Appl. No.: 08/936,104

[22] Filed: Sep. 23, 1997

[30] Foreign Application Priority Data

Sep. 26, 1996 [GB] United Kingdom ..... 9620092

[51] Int. Cl.[6] ..... A46B 9/02

[52] U.S. Cl. ..... 15/201; 15/167.1

[58] Field of Search ..... 15/110, 167.1, 15/201

[56] References Cited

U.S. PATENT DOCUMENTS

| | | |
|---|---|---|
| 4,633,542 | 1/1987 | Taravel . |
| 5,109,563 | 5/1992 | Lemon et al. . |
| 5,313,909 | 5/1994 | Tseng et al. . |
| 5,373,602 | 12/1994 | Bang . |

FOREIGN PATENT DOCUMENTS

| | | |
|---|---|---|
| 0 159 940 | 10/1985 | European Pat. Off. . |
| 0 613 636 | 9/1994 | European Pat. Off. . |
| 0 648 448 | 4/1995 | European Pat. Off. . |
| 2 579 087 | 3/1995 | France . |
| 1 657 299 | 5/1967 | Germany . |
| 09019323 | 1/1997 | Japan . |
| 92/17092 | 10/1992 | WIPO . |
| 92/17093 | 10/1992 | WIPO . |
| 92/17094 | 10/1992 | WIPO . |
| 94/13174 | 6/1994 | WIPO . |
| 95/30350 | 11/1995 | WIPO . |
| 97/07707 | 3/1997 | WIPO . |
| 97/14330 | 4/1997 | WIPO . |
| 91/20484 | 6/1997 | WIPO . |

*Primary Examiner*—Terrence R. Till
*Attorney, Agent, or Firm*—Milton L. Honig

[57] ABSTRACT

A brush having a handle at one end thereof and a bristle bearing head characterised in that the bristles are anchored in an elastomeric bridge disposed between the bristles and the head, the bridge forming a bond between the bristles and the head.

13 Claims, 2 Drawing Sheets

BRUSH HAVING AN ELASTOMERIC BRIDGE

BACKGROUND OF THE INVENTION

1. Field of the Invention

The invention relates to a brush having an elastomeric component and a non-elastomeric component and to a method of producing such a brush.

2. Description of the Related Art

Conventional brushes comprise bristles mounted in rigid head materials. The rigid head material provides support for the bristles. The bristle material and the head material demand different physical properties. Accordingly, brush heads and bristles are frequently manufactured from different materials e.g. polyolefins and polyamides which do not bond efficiently. Accordingly, the bristles must be frequently mechanically attached to the brush using staples, stops and the like.

The bristles are generally mounted on the brush in a substantially upward orientation. Following use over a prolonged period the bristles tend to splay permanently outwards from the upward orientation whereupon the brush is discarded and replaced.

The abovementioned problems are particularly common with toothbrushes.

However, it has been found that an improved cleaning operation can be performed with a toothbrush in which the bristles are splayed or adapted to splay in a controllable and repeatable manner. Accordingly, toothbrushes have been developed in which the toothbrush head is flexible to facilitate movement of the bristles in use. The flexible head is usually made up of jointed portions or segments which facilitate articulation of groups of bristles. However, a disadvantage of such segments is that unwanted foreign matter can accumulate in spaces between the segments and that individual tufts cannot articulate independently of one another.

Fine bristles can exhibit and enhance a splaying effect. In addition, applicant has found that fine bristles produce a more effective cleaning effect as they penetrate further into the interproximal spaces between the teeth and gums. However, it has been found that fine bristle tufts are particularly susceptible to excessive permanent splaying in use thereby reducing cleaning efficacy. Accordingly, rapid deterioration of the toothbrush results.

Our co-pending British Patent Application of even date, the contents of which are incorporated herein by reference, describes a toothbrush having bristles embedded in an elastomeric component which in turn is attached to a plastics extension of a plastics toothbrush handle.

An object of the invention is to provide a brush having bristles flexibly mounted in a material which is compatible with the material of the bristles and the material of the brush head.

A further object of the invention is to provide a toothbrush having a head with bristles mounted thereon in which the bristles mounted on the toothbrush head can repeatably and resiliently splay and move in a multidirectional manner to provide more effective cleaning.

SUMMARY OF THE INVENTION

According to the invention there is provided a brush having a handle at one end thereof and a bristle bearing head characterised in that the bristles are anchored in an elastomeric bridge disposed between the bristles and the head, the bridge forming a bond between the bristles and the head.

The invention also provides a method of producing a brush having a non-elastomeric handle at one end thereof and a bristle bearing head comprising anchoring the bristles in an elastomeric bridge material and bonding the bristles to the head with said elastomeric material.

BRIEF DESCRIPTION OF THE DRAWING

The invention will now be described having regard to the accompanying drawings in which.

DETAILED DESCRIPTION OF THE INVENTION

Figure 1:
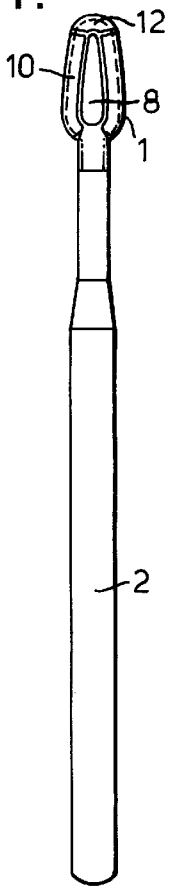
FIG. 1 is a top plan view of a first embodiment of a toothbrush of the invention showing the handle and toothbrush head with the bristles shown in broken lines.
Figure 2:
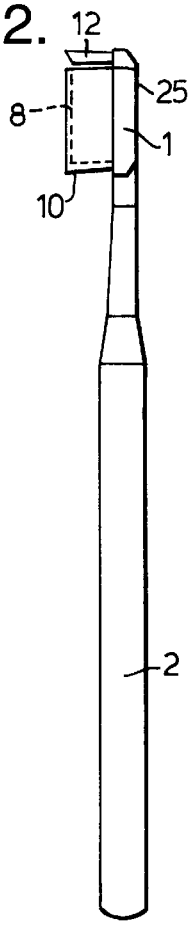
FIG. 2 is a side elevation of the toothbrush of FIG. 1.

FIGS. 1 to 9 show a first embodiment of a brush of the invention. FIG. 1 shows a top plan view of a toothbrush of the invention while FIG. 2 shows a side elevational view of the toothbrush.

As shown in FIGS. 1 and 2, the toothbrush is made up of a head (1) and a handle (2).

Figure 3:
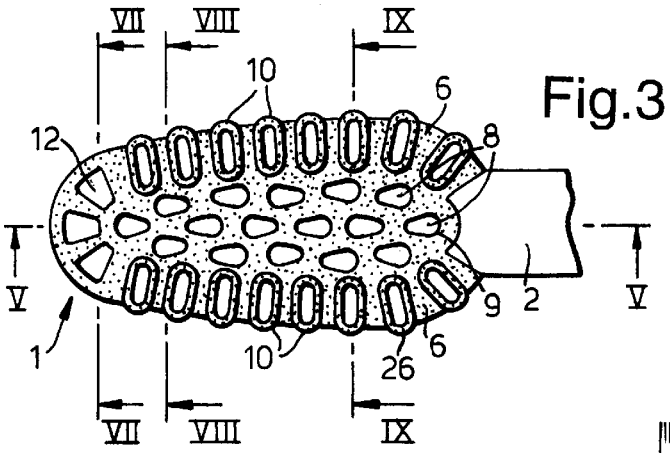
FIG. 3 is a top plan view of the first embodiment of a toothbrush head of the invention in which the peripheral arrays of bristles are booted.
Figure 4:
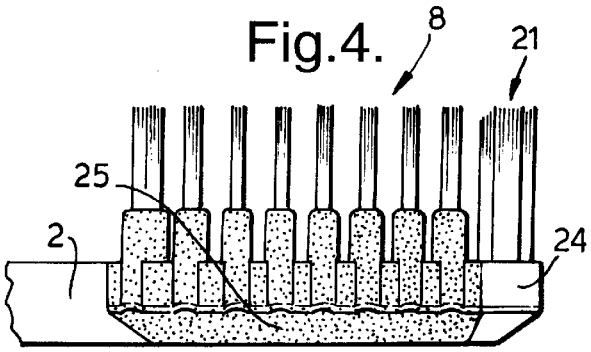
FIG. 4 is a side elevation of the toothbrush head.

FIG. 3 shows a top plan view of the toothbrush head of FIGS. 1 and 2 while FIG. 4 shows a side elevation of the toothbrush head.

Figure 5:
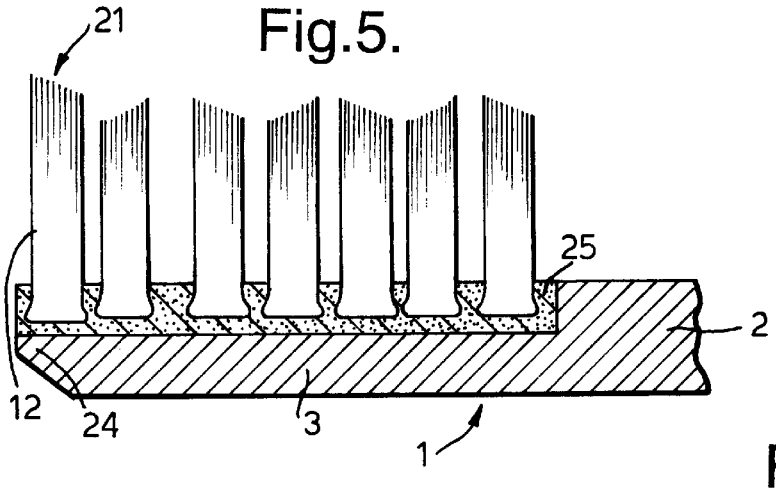
FIG. 5 is a cross sectional view along the line V—V of FIG. 3.
Figure 6:
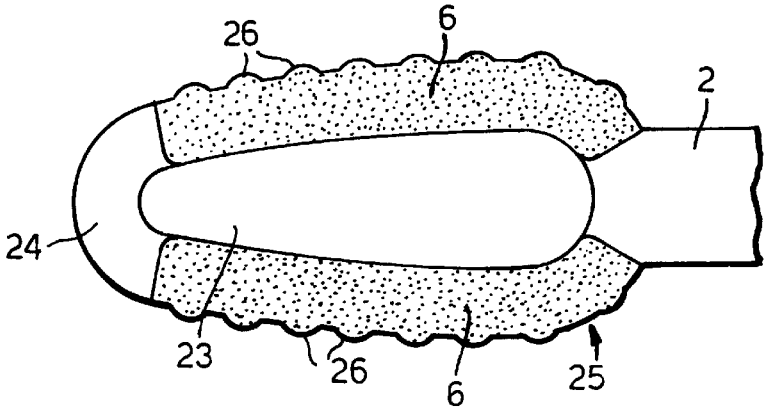
FIG. 6 is a bottom plan view of the toothbrush head of FIG. 1.

FIG. 5 shows a longitudinal cross-section through the toothbrush head along the line V—V of FIG. 3 while FIG. 6 shows an underneath plan view of the toothbrush head.

As shown in the drawings, the head (1) is mounted or internally moulded at one end of the handle (2) and is made up of an undercarriage-type skeleton (3) in which a resilient elastomeric head block (25) (shown shaded) is disposed. The skeleton (3) has a narrow elongate ellipsoidal portion (23) which is a continuation of the handle (2). At the end remote from the handle (2), the skeleton (3) is expanded laterally outwards to define a semi-circular tip portion (24) in head tip (21). The semi-circular tip portion is most clearly illustrated in FIG. 6.

The head block (25) is supported by the ellipsoidal portion (23) and the semi-circular tip portion (24). The elastomeric head block (25) extends laterally outwards from i.e. stands proud of the ellipsoidal portion (23) and extends upwards from the ellipsoidal portion (23) to define two resilient elastomeric side members (6). Therefore, the resilient side members (6) are not directly mounted on the skeleton (3) and hence have greater flexibility than the portion of the head block (25) which is mounted on the skeleton (3).

The under carriage-type skeleton (3) increases the surface area of the head to facilitate bonding of the side members (6) to the head (1). The head block (25), when viewed from a top plan view as shown in FIG. 3, entirely covers the toothbrush head. However, when viewed from the side as shown in FIG. 4 and from underneath as shown in FIG. 6, the under carriage nature of the skeleton (3) is more clearly visible and clearly shows that the under carriage portion partially surrounds the head block (25).

The head (1) is provided with a centre array of plastics bristles (8) made up of a substantially tear or pear-shaped bristle tufts (9) when viewed from above and two side arrays (10) either side of the centre array (8) made up of linear bristle tufts (11) disposed substantially perpendicular to the longitudinal axis of the handle (2). The semi-circular tip (24) is further provided with a tip array (12) of bristles having a substantially frustoconical outline when viewed from above as shown in FIG. 3.

The side array of bristles (10) are provided with elastomeric boots (7) which extend upwards from the head block (25) and are moulded from the same material as the head block (25). The linear tufts of the side arrays (10) are supported by the boots (7) and are restrained within the boots (7) by a bond between the resilient material of the head block (25) and the material of the bristles of the linear tufts (11).

The linear tufts (11) are made up of bristle filaments which can flex and splay outwards from the centre afray (8) in use. Fine bristle filaments, which can also be used, enhance the splaying effect. The flexibility of the linear tufts (11) is further enhanced by the manner in which the resilient side members (6) stand proud of the under carriage skeleton (3).

However, due to the resilience of the side members (6) and of the boots (7), the linear tufts (11) return to their original positions following use and do not exhibit excessive splaying.

Figure 7:
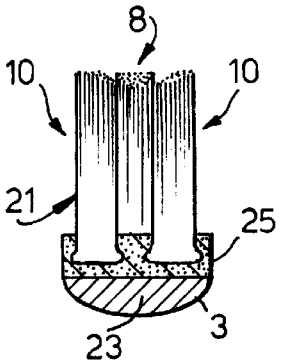
FIG. 7 is a cross sectional view along the line VII—VII of FIG. 3.
Figure 8:
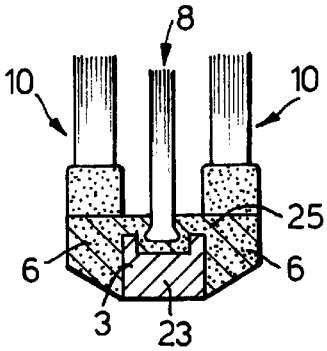
FIG. 8 is a cross sectional view along the line VIII—VIII of FIG. 3.
Figure 9:
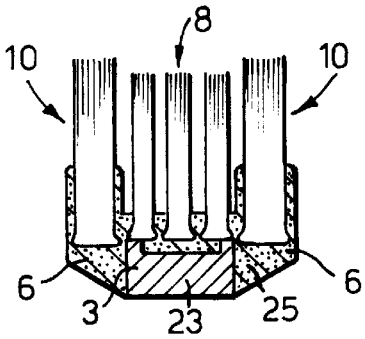
FIG. 9 is a cross-sectional view along the line IX—IX of FIG. 3.

FIGS. 7 to 9 show cross-sectional views along the lines VII—VII, VIII—VIII, IX—IX respectively of FIG. 3 and illustrate varying longitudinal dimensions of the ellipsoidal portion (23) of the undercarriage skeleton (3). As shown in the drawings, the skeleton (3) is partially surrounded by the head block (25) while the skeleton (3) varies in thickness along the length of the ellipsoidal portion (23) to increase the surface area of the head (1) to facilitate bonding of the side members (6) and to vary the degree of flexibility of the brush head along its length without the need to utilise segments or spaces in the toothbrush head.

Similarly, the thickness of the head block (25) surrounding the skeleton (23) is varied to provide varying degrees of flexibility in the toothbrush head.

The boots (7) of the side arrays (10) also stand slightly proud of the side walls of the side members (6) to provide an uneven surface on the periphery of the toothbrush head. The uneven or undulating periphery of the toothbrush head formed by the resilient material of the boots (7) can therefore be utilised to provide a massaging effect to the teeth and/or gums in use.

The handle (2) and the skeletal extension thereof (3) are made up of a comparatively rigid material i.e. a material having a modulus of elasticity which is higher than the modulus of elasticity of the head block (25).

Accordingly, the handle (2) and skeleton (3) can be moulded from polyolefins such as polypropylenes and polyethylenes, polyamides such as nylons, and polyesters such as polyethylene terephthalate. Other suitable materials for the handle (2) and skeleton (3) include polymethylmethacrylate, styrene acrylonitrile and cellulose esters, for example cellulose propionate.

The bristles of the brush (1) are made from a flexible material suitable for use in dental hygiene. Generally, materials suitable for the bristles are polyamides such as nylon or polyesters such as polybutylene terephthalate.

The elastomeric head block (25) functions firstly as a support to anchor the bristles and facilitate repeated flexing of the bristles and secondly as a bridge which is compatible with the skeleton (3) and the bristles to securely maintain the structural integrity of the toothbrush.

Preferably, the elastomeric bridge is made of a polymer material, such as a block co-polymer. Preferred block copolymers include styrenes (for example styrene ethylene butadiene styrene, or styrene butadiene styrene), polyolefins (for example polypropylene/ethylene propylene diamine modified systems (i.e. synthetic rubber)), polyamides (for example polyamide (2 or polyamide 6), polyesters (for example polyester ester or polyether ester), polyurethanes (for example polyesterurethane, polyetherurethane or polyesteretherurethane).

Preferred elastomeric bridge materials can be two phase systems, which contain an internal phase material in a continuous phase of another material. A particularly preferred example of this is the polypropylene/ethylene propylene diamine modified material described above, which is commercially available as Santroprene PPA (ex Advanced Elastomer Systems). Such two phase materials may conveniently have a continuous external thermoplastic phase, with the internal phase typically containing particles which may be in the order of 0.5–5 microns across.

Alternatively, the material which comprises the elastomeric bridge may be surface modified by grafting on other polymers to facilitate the bonding of the elastomeric bridge to either the bristle material, or the handle/skeleton material, or both.

Other methods of surface modification of one or more components are contemplated to facilitate adhesion of the elastomeric bridge to either the bristles or the handle/skeleton, or both. For example, compatabilizer materials can be incorporated into one of the components of the brush (i.e. handle/skeleton, elastomeric bridge or bristles), though for processing simplicity it is preferred that any such compatabilizer materials be added to the bristles. Such compatabilizer materials can be added to the bulk material from which the component is made, and will facilitate its adhesion to another component.

Alternatively, one or more components (though again for processing simplicity it is preferably the bristles) can be chemically (modified by a chemical surface treatment to facilitate its adhesion to an adjacent component. Alternatively, one or more components can be modified by surface oxidation (e.g. by flaming, or by electrical discharge) to facilitate its adhesion to an adjacent component.

In a preferred embodiment, to facilitate end simplify bonding of the handle/skeleton and bristles to the elastomeric bridge, the handle/skeleton and bristles may be made of materials which are of similar or even the same character, so that they for example have similar functional groups, similar levels of functionality, similar surface energies, and so no. Such similarity may facilitate adhesion of the respective components, and in a preferred embodiment the handle/skeleton and bristles may be made of the same materials, for example nylon materials.

Preferred elastomeric bridge materials are thermoplastic elastomers for ease of injection moulding.

The elastomeric bridge of the invention ensures that the head block (25) is securely bonded to the skeleton (3) whilst securely embedding or anchoring the bristles in situ without necessarily the aid of attachment means such as stapling. Embodiments are contemplated where the bristles may be physically retained with the use of e.g. staples, but also where the bristles are bonded to the elastomeric bridge material.

A preferred material for the handle (2) and skeleton (3) is polypropylene whilst a preferred material for the bristles is NYLON.

NYLON has the advantage that it is hard wearing and less abrasive than materials such as polyesters. Nevertheless, in alternative embodiments of the invention, the bristles can be formed from a polyester material.

The bridge or head block (25) serves as a secure link between the bristles and the skeleton (3) and is mutually compatible with the skeleton (3) and the bristles to form secure bonds with both structures without the aid of staples or other attachment means.

In a further preferred embodiment of the invention, the head block (25) is made of a nylon elastomer blended with polypropylene and styrene ethylene butadiene styrene (SEBS) materials. The resulting elastomeric material has the elastomeric properties required for the block or bridge (25) but bonds or adheres securely to both polyamides and polypropylene. A preferred elastomer is OREVAC PPC, a polyolefin based binder resin, available from ATO and blended with the polypropylene and SEBS materials at a level of 20%. No other mechanical attachment means are required.

An alternative mutually compatible block or bridge (25) for use with NYLON bristles and a polypropylene skeleton (3) is another polyamide elastomer known as Vestamid available from Huls.

In an alternative embodiment of the invention, the bridge material is a thermoplastic polyurethane which adheres to both the nylon bristles and the polypropylene skeleton (3). A preferred thermoplastic polyurethane is ESTANE available from BF Goodrich e.g. ESTANE 58201 (82A) (PET) and ESTANE 58271 (88A) (PES).

An alternative bridge material is a Kraton based elastomer which adheres to polyolefins and polyamides. KRATON materials are available from Shell. A particularly preferred KRATON based material which bonds to nylon is available from EVODE under the trade name EVOPRENE.

As alternative elastomeric materials can be used elastomers formed from the polymer SEPTON available from PTS.

In an alternative embodiment of the invention, the handle (2), skeleton (3), block or bridge (25) and bristles are manufactured from polyamide materials. For instance, materials such as ORGALOY (an alloy of polyamide and polypropylene available from ATO) which adheres to polyamides and polyolefins can be used for forming toothbrush bristles; TROGAMID (a transparent polyamide available from Huls) for the handle (2) and skeleton (3), and VESTAMID a nylon elastomer also available from Huls for the block or bridge (25).

Alternatively, a material such as SURLYN, available from DuPont or VISTALON, a maleic anhydride modified EPDM rubber available from Exxon is utilized for the block or bridge (25). Both materials bond to a NYLON skeleton (3) and nylon bristles.

Blends of elastomers known as ADMER and MILASTOMER, available from Mitsui, can also be used to achieve an elastomer having the desired softness for the block or bridge (25) but which adhere to polyamides. Suitable grades of ADMER and MILASTOMER are QF551 and 6DM.

The brush of the invention can be manufactured using various moulding techniques known in the art including overmoulding and injection moulding techniques.

Injection moulding is the preferred method. A suitable injection moulding technique is multi-component injection moulding combined with a tunnelling effect. In this method the bristles are first suspended from a metal plate in a toothbrush mould. Subsequently, the elastomeric material of the head block (25) and the material of the handle (2) and skeleton (3) are injected into the mould.

The elastomeric material of the head (25) is injected inside the material of the handle (2)/skeleton (3) or head tip (24) i.e. it is tunnelled inside the material of the handle (2)/skeleton (3) or head tip (24) and can emerge from inside the handle (2)/skeleton (3) or head tip (24) to the exterior of the toothbrush at pre-determined locations.

For example, in the embodiment shown in FIGS. 1 to 9 the elastomer material has emerged the head block (25) to form the head block (25) to anchor the bristles. The elastomer could also emerge at pre-determined locations on the handle (2) to provide grips for a decorative effect.

Following the injection process the metal plate supporting the bristles is removed.

The head block (25) and hence the flexible side members (6) and the use of fine bristles together with boots (7) provides a self-adjusting tuft design which delivers effective brushing whilst ensuring that the structural integrity of the brush is maintained.

The side linear tufts (11) of the side array (10) are supported by the flexible boots (7). Generally, the bristle tufts of the side arrays (10) can be 50% narrower than conventional bristle tufts such that the bristles will spread or splay with ease as they meet resistance against teeth in use. Such automatic fanning of the bristles facilitates deeper gum line and interproximal penetration without the high forces and discomfort that are experienced with traditional geometries. The flexible boots reinforce the bristles to offset the relative softness of the bristles to provide a resilient memory which preserves the tuft shape.

The mounting of the tufts of bristles together with the boots (7) on the side member (6) allow individual tufts (9) to independently flex and adjust to the irregular dental topography.

Therefore, the combination of flexing of the boots (7) and the side member (6) lowers the point at which the tufts bend to be lowered closer to the head thereby creating a toggle effect that ensures that bristles remain in crevices longer for superior plaque removal. Accordingly, the bristles can adjust in all directions to ensure continuous bristle contact in the complex architecture of the teeth and gums.

The alternating surfaces and shapes of the centre array of bristles (8) facilitate the removal of plaque from the triangular spaces between adjoining teeth and broad tooth surfaces. The alternating surfaces and the tear drop shaped tufts as shown in FIG. 3 for example provide each tuft with two cleaning actions that work simultaneously and deliver a dynamic action when downward force and horizontal pressure is applied to the brush head. The narrow long side of the array (8) deeply penetrates the spaces between the teeth while the wide short side of the tear drop shape or pear shape offers increased stiffness maximising the cleaning contact with the tooth. The individual movement potential of the tufts facilitate contact by the individual tufts to multiple tooth surfaces without being pushed away or structurally supported by adjacent tufts.

The tip tufts (12) are suitably made of dense tufts of bristles which are configured radially at the tip (21) of the brush and are comparably more narrow than the other tuft groups on the brush head. The tapered nature of the ellipsoidal shaped brush head allows for increased rear molar access. Moreover, the elastomeric rubber tip as shown in FIG. 3 and the elastomeric wings of side member (6) of the brush head act as a soft bumper to increase comfort while accessing tight often ignored areas of the mouth. The radially sloped trim of the tip tufts provide superior reach and bristle tips maximising plaque removal on the back sides of rear molars.

An advantage of the toothbrushes of the invention having bristles flexibly anchored in a skeleton and bristle compatible material is that the use of separably moveable tufts on the outer edge of the brush head having soft flexible rubber holders containing fine filaments facilitates access to previously inaccessible areas of the tooth.

The structurally robust yet flexible arrangement ensures that the bristles are surface sensitive in that each tuft of bristle moves independently in an upward/downward direction, responding to the changing contour of teeth. This enables the toothbrush bristles to penetrate and remove plaque from difficult to reach places in which plaque bacteria are to be found.

The filaments or bristles can be co-extruded and a single brush can have filaments manufactured from a combination of such materials.

I claim:

1. A brush comprising:

a handle with first and second ends, and a bristle bearing head attached to the first end of the handle comprising bristles anchored in an elastomeric bridge disposed between the bristles and the head, the bridge forming a bond between the bristles and the head and comprising a two-phase polymer system having a continuous external thermoplastic phase and an internal phase containing particles.

2. A brush as claimed in claim 1 wherein the head comprises a skeleton to support the bridge.

3. A brush as claimed in claim 2 wherein the handle and skeleton comprise a polyolefin material.

4. A brush as claimed in claim 3 wherein the polyolefin is polypropylene.

5. A brush as claimed in claim 4 wherein the bristles comprise a polyamide material.

6. A brush as claimed in claim 1, wherein the two phase polymer system is selected from the group consisting of styrene, polyolefin, polyamide, polyester and polyurethane.

7. A brush as claimed in claim 1, wherein the handle and bristles are made of the same materials.

8. A brush as claimed in claim 1 wherein it is a toothbrush.

9. A brush according to claim 1 wherein the particles are of a size 0.5–5 microns.

10. A brush comprising:

a handle with first and second ends; and a bristle bearing head attached to the first end of the handle comprising bristles anchored in an elastomeric bridge disposed between the bristles and the head, the bridge forming a bond between the bristles and the head and comprising a surface modified polymer which has been modified by surface oxidation.

11. A brush comprising:

a handle with first and second ends; and a bristle bearing head attached to the first end of the handle comprising bristles anchored in an elastomeric bridge disposed between the bristles and the head, the bridge forming a bond between the bristles and the head and comprising a compatibilizer material.

12. A brush as claimed in claim 11, wherein the compatibilizer material is in the bristles.

13. A brush comprising:

a handle with first and second ends; and a bristle bearing head attached to the first end of the handle comprising bristles anchored in an elastomeric bridge disposed between the bristles and the head, the bridge forming a bond between the bristles and the head and comprising a polyamide based elastomer which is a nylon-polypropylene-styrene ethylene butadiene styrene blend.

* * * * *